US007563127B2

(12) United States Patent
Kurahashi

(10) Patent No.: US 7,563,127 B2
(45) Date of Patent: Jul. 21, 2009

(54) CONNECTOR WITH BUILT-IN CIRCUIT ELEMENT

(75) Inventor: Takaaki Kurahashi, Anjo (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/907,087

(22) Filed: Oct. 9, 2007

(65) Prior Publication Data

US 2008/0085636 A1 Apr. 10, 2008

(30) Foreign Application Priority Data

Oct. 10, 2006 (JP) ..... 2006-276522

(51) Int. Cl.
*H01R 13/58* (2006.01)

(52) U.S. Cl. ..... 439/474; 439/276; 439/936; 439/620.01; 439/620.04; 439/620.08

(58) Field of Classification Search ..... 439/276, 439/936, 620.15, 620.01, 620.04, 620.08, 439/474

See application file for complete search history.

(56) References Cited

U.S. PATENT DOCUMENTS 5,624,269 A * 4/1997 Kanamori ..... 439/83
6,033,189 A 3/2000 Miura et al.
6,291,913 B1 9/2001 Nikawa et al.
6,390,854 B2 5/2002 Yamamoto et al.

FOREIGN PATENT DOCUMENTS

JP A-10-318403 12/1998
JP A-2001-016829 1/2001
JP A-2002-033438 1/2002

* cited by examiner

*Primary Examiner*—Tho D Ta
(74) *Attorney, Agent, or Firm*—Oliff & Berridge, PLC

(57) ABSTRACT

A connector for a vehicular AC generator includes a resin connector case having an element-accommodating chamber in which a leaded circuit element having a pair of leads at opposite ends is received. The leads are bent at right angles and soldered at respective tip end portions to element connecting terminals of wiring metal pieces embedded in the connector case. The element-accommodating chamber is filled with an elastic sealing resin. The right-angled leads take up or absorb the difference in thermal expansion between the connector case and the circuit element including the leads. The elastic sealing resin prevents a crack from occurring at an interface boundary between the circuit element and the leads and offers an improved environmental resistance.

5 Claims, 8 Drawing Sheets

CONNECTOR WITH BUILT-IN CIRCUIT ELEMENT

CROSS REFERENCE TO RELATED APPLICATION

The present application is based on and claims priority from Japanese Patent Application No. 2006-276522, filed Oct. 10, 2006, the content of which is incorporated herein by reference.

BACKGROUND OF THE INVENTION

1. Field of the Invention

The present invention relates generally to connectors, and more particularly to a connector having a circuit element built therein.

2. Description of the Related Art

Vehicular AC (alternating current) generators have a connector for communication of signals with external electronic control units (ECUs). Typical examples of such vehicular AC generators are disclosed in Japanese Patent Laid-open Publications (JP-A) Nos. 2001-016829 (corresponding to U.S. Pat. No. 6,291,913 B1) and 2002-033438 (corresponding to U.S. Pat. No. 6,390,854 B2). It has been a conventional practice that a circuit element such as surge absorber is incorporated or built in the connector. Such connector having a circuit element built therein will be hereinafter referred to as "connector with a built-in circuit element". The circuit element to be built in the connector may include capacitors, resistance elements, varistors, various passive or active elements, and ICs. For these circuit elements, leaded circuit elements, which do not need a circuit board, are employed. The leaded circuit elements each have leads extending in a longitudinal direction from opposite ends thereof.

One example of such conventional connectors with a built-in circuit, which is employed in a vehicular AC generator, will be described with reference to FIGS. 7 to 9. FIG. 7 is a front elevational view of the connector, FIG. 8 is a rear elevational view of the connector, and FIG. 9 is a vertical cross-sectional view of the connector with sealing resin filled therein.

In FIGS. 7-9, reference numeral 100 denotes a connector case as a resin molded article, 102 to 105, wiring metal pieces fixed or embedded in the connector case 100 by insert molding or resin molding; and 106, a leaded circuit element. The connector case 100 includes a body portion 112 of rectangular block-like configuration having laterally-elongated element accommodating chambers 111*a* and 111*b*, and a tubular connector portion 113 projecting from the body portion 112 in an upward direction in FIGS. 7-9 The leaded circuit element 106 has an element body 160 and a pair of leads 161 and 162 extending from opposite ends of the element body 160 in a longitudinal direction thereof The leaded circuit element 106 solely or in combination with another circuit element offers the function of a surge absorbing circuit such as snubber circuit. A tip of the lead 161 is soldered to an element-connecting terminal 132 of the wiring metal piece 103, and a tip of the lead 162 is soldered to an element-connecting terminal 152 of the wiring metal piece 105. Numeral 200 shown in FIG. 9 denotes a partition wall provided in the connector case 100 to isolate the element accommodating chamber 111*a* on the front side from the element accommodating chamber 111*b* on the rear side.

The conventional connector with a built-in circuit element shown in FIGS. 7-9 has a problem, however, that the leads 161 and 162 may be damaged or otherwise broken when the connector is used in a high-temperature environment. This problem will be discussed below in greater detail with reference to FIG. 7.

In a high-temperature environment, the resin connector case 100 undergoes thermal expansion. In this instance, a temperature-dependent dimensional change occurring at the lateral distance L between the element-connecting terminals 132 and 152 fixed to the connector case 100 is approximately equal to the product of a coefficient of thermal expansion of the connector case 100 and the lateral distance L. On the other hand, the leads 161 and 162 are made of metal and have a smaller coefficient of thermal expansion than the resin connector case 100. Thus, due to the difference in thermal expansion, the metal leads 161, 162 soldered to the element-connecting terminals 132, 52 are subjected to a tensile force and, hence, a lateral stress is developed in each of the soldered joint portions between the leads 161, 162 and the element-connecting terminals 132, 152. In the event that the lateral stress occurs repeatedly, the soldered joint portions will cause a fatigue breakdown. Since the vehicle engine room temperature shows a tendency to increase, the connector with a built-in circuit element for use in a vehicular AC generator installed in the engine room is required to solve the foregoing problem.

Japanese Patent Laid-open Publication (JP-A) No. 10-318403 (corresponding to U.S. Pat. No. 6,033,189) shows a prior proposal for preventing a fatigue breakdown from occurring, wherein the leads of a leaded circuit element have a bent portion to absorb a displacement caused due to temperature variations. The prior proposal is, however, directed to a control valve for compressors, which has a resin molded structure in its entirety with a circuit element integrally molded with a body of the resin molded control valve. If this structure is employed in a vehicular AC generator, since the vehicular AC generator per se forms a high-temperature heat source as compared to the compressor, the circuit element and its peripheral portion will be subjected to a great thermal stress, tending to form a crack at interface boundary between the molded resin and the circuit element or between the molded resin and the leads of the circuit element. Additionally, since the vehicular AC generator is placed in a use environment with high risk of getting wet with water, water entering the crack may cause an insulation failure or short between the leads of the circuit element or the circuit element itself, resulting in malfunction of the AC generator.

SUMMARY OF THE INVENTION

With the foregoing difficulties in view, the present invention seeks to provide a connector with a built-in circuit element for a vehicular AC generator, which has highly reliable heat-resisting properties.

According to the invention, there is provided a connector for a vehicular AC generator, comprising: a resin connector case having a sealed element accommodating chamber for receiving therein a circuit element; a leaded circuit element received in the element accommodating chamber and having a pair of leads protruding from opposite longitudinal ends thereof; and a plurality of wiring metal pieces embedded in the resin connector case, each of the wiring metal pieces having an external connecting terminal projecting from an outer wall of the connector case for external connection, and an element connecting terminal projecting into the element accommodating chamber and soldered to a tip end portion of each of the leads of the leaded circuit element. Each of the leads has a bent portion, which is bent at an angle of 45 degrees or greater within the element-accommodating chamber, and the element-accommodating chamber is filled with an elastic sealing resin.

With this arrangement, since the leads at the opposite ends of the leaded circuit element are soldered to the element connecting terminals of the wiring metal pieces with the respective bent portions disposed intermediately between the element connecting terminals and a body portion of the leaded circuit element, the difference in thermal expansion between that portion of the connector case extending between the element connecting terminals and the leaded circuit element soldered to the element connecting terminals can be readily taken up or absorbed via elastic deformation of the respective bent portions of the pair of leads of the leaded circuit element. The connector can thus offer a good resistance to thermal stress. Furthermore, since the leads having the bent portions can reduce or shorten the overall length of the leaded circuit element, the length of the connector case portion extending between the soldered joint portions is reduced correspondingly. Thus, the aforesaid difference in thermal expansion can be reduced with the result that a further improvement in the thermal stress resisting properties can be attained.

Additionally, since the element-accommodating chamber of the connector case is filled with the elastic sealing resin, this structure provides the connector with an improved degree of heat resisting properties and a high environmental stress cracking resistance. In general, due to the bent portions formed on the leads, the leaded circuit element is likely to displace in the longitudinal direction thereof when the connector is subjected to external vibrations. However, this problem does not take place for the connector of the present invention because the leaded circuit element is stably held in position against displacement within the element-accommodating chamber by means of the elastic sealing resin filled in the element-accommodating chamber. As compared to a molding resin, which seals the element-accommodating chamber at the same time it forms the connector case, the elastic sealing resin is able to prevent a crack from occurring at an interface boundary between the sealing resin and the circuit element even when subjected to repeated thermal stresses. In the absence of a crack, the connector does not allow for the entry of water, which may otherwise lead to an insulation failure.

The bent portions of the leads may have a bent angle much larger than 45 degrees. For instance, each of the leads may be bent at approximately 180 degrees (or folded on itself about the bent portion). In this case, since the distance between the tip end portions of the leads joined by soldering to the element connecting terminals is greatly reduced, the aforesaid difference in thermal expansion can be greatly reduced correspondingly. The bent portions of the leads may have a corrugated or wavy shape.

In one preferred form of the present invention, the connector case further has a lead support wall disposed between the tip end portion and the bent portion of each of the pair of leads and supporting thereon a portion of each respective lead. The lead support wall extends perpendicularly to each respective lead and has a recess in which the lead is received. The lead support wall thus provided keeps the tip end portion (soldered portion) of the each lead away from the influence of a thermal deformation of the bent portion caused due to temperature variations. Furthermore, the lead support wall is also able to effectively suppress a vibration-induced problem, which may occur at the soldered tip end portion of the lead when vibrations of the leaded circuit element caused due to vibrations of the vehicle enlarge the deformation of the bent portion of the lead.

Preferably, the leads of the leaded circuit element are bent parallel to each other at right angles in the same direction. By thus arranging the leads o the leaded circuit element, it is possible to reduce the overall size of the element-accommodating chamber.

In one preferred form of the invention, the connector case has a rectangular block-like configuration having a flat first wall, a flat second wall extending perpendicularly from one end of the first wall, and a flat third wall extending perpendicularly from the other end of the first wall and parallel to the second wall. The element-accommodating chamber includes an element receiving portion extending substantially parallel to and along the first wall of the connector case and receiving therein a body portion of the leaded circuit element in substantially parallel spaced relation to the first wall, a first lead receiving portion extending substantially parallel to and along the second wall of the connector case and receiving therein one of the pair of the leads in substantially parallel spaced relation to the second wall, and a second lead receiving portion extending substantially parallel to and along the third wall of the connector case and receiving therein the other lead in substantially parallel spaced relation to the third wall. With this arrangement, since the leads having the bent portions of the leaded circuit element are arranged to extend along three surfaces of the rectangular block-like connector case, it is possible to reduce the overall size of the connector case while the leads of the leaded circuit element are kept out of interference with another leaded circuit element received in the element-accommodating chamber.

Preferably, the connector case further has a pair of lead support walls extending perpendicularly to each other and supporting each of the leads at portions located on opposite sides of the bent portion of each respective lead. By thus arranging the pair of lead support walls thus arranged, it is possible to prevent displacement of a body portion of the leaded circuit element caused due to vibrations of the vehicle and deformation of the bent portion of the lead resulting from the displacement of the circuit element body portion. Thus, the vibration-induced fatigue of the lead can be avoided. Furthermore, the pair of lead support walls extending in two mutually perpendicular directions are able to support each lead while controlling deformation of the lead, which may otherwise occur in various directions under the effect of external vibrations.

In one preferred embodiment of the invention, the element connecting terminal has a joint end portion completely separated from the connector case and soldered to the tip end portion of each lead, a base portion opposite to the joint end portion and fully embedded in the connector case, and a contact exposure portion disposed between the joint end portion and the base portion, the contact exposure portion being in close contact with an inner wall surface of the connector case only at a surface thereof which is hidden when viewed from an open side of the element-accommodating chamber. With this arrangement, the element connecting portion of the wiring metal piece is relatively long and, hence, the difference in thermal expansion between the connector case and the leaded circuit element is partially accommodated by thermal deformation of the element connecting terminal. This is particularly effective to improve the thermal stress resisting performance of the connector.

DETAILED DESCRIPTION OF THE PREFERRED EMBODIMENT

Figure 1:
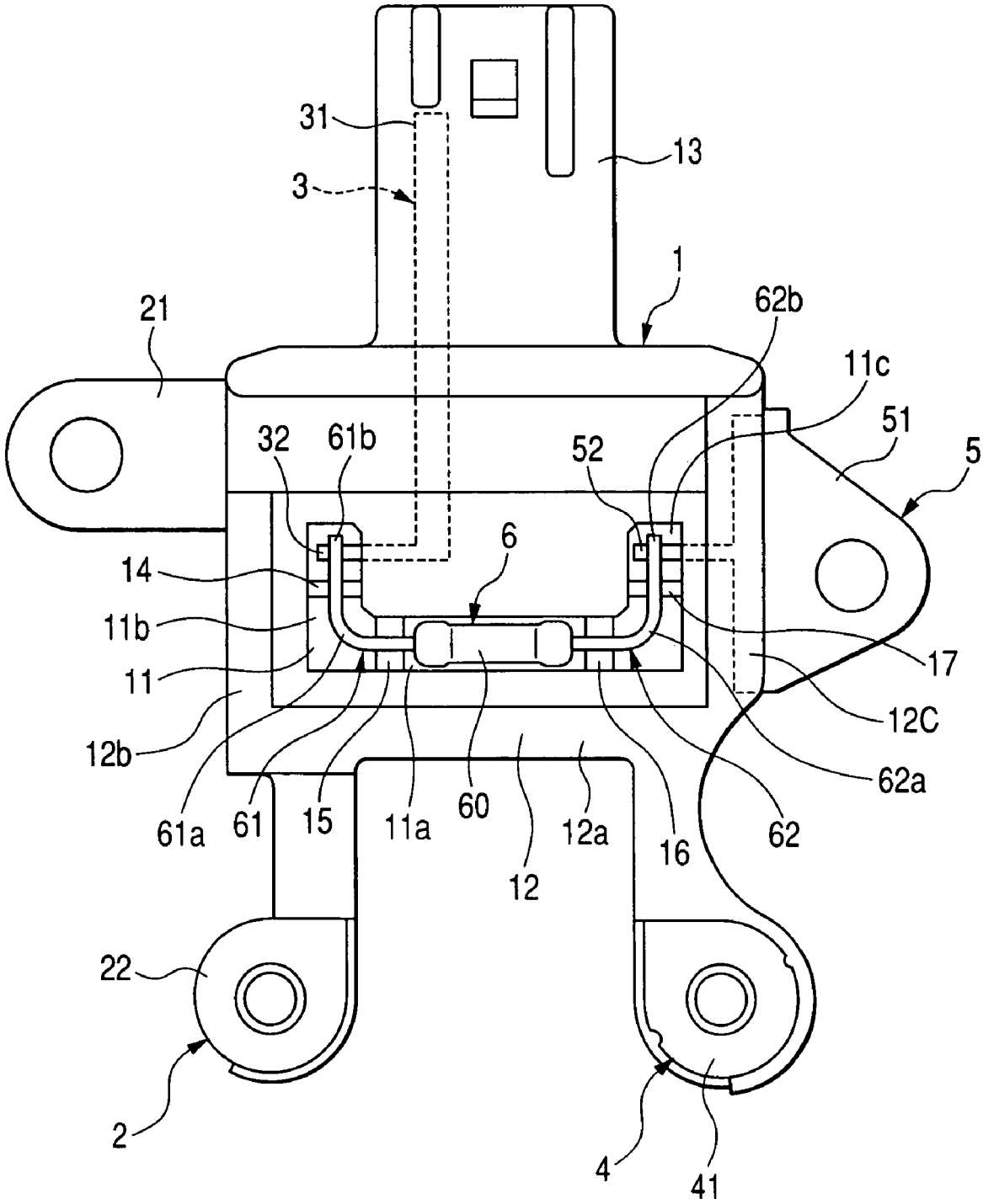
FIG. 1 is a front elevational view of a connector for vehicular AC generators according to one preferred embodiment of the present invention.
Figure 2:
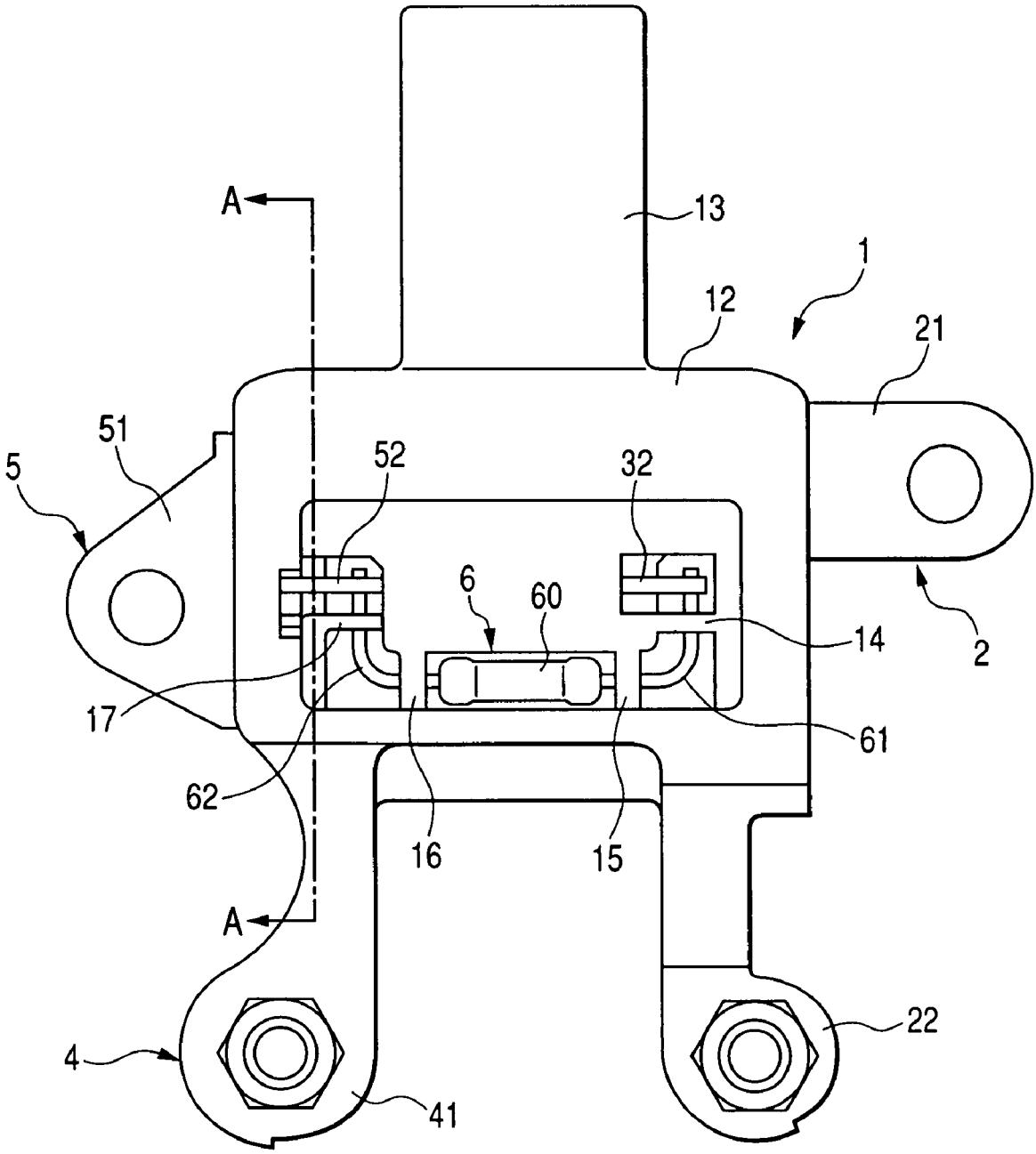
FIG. 2 is a rear elevational view of the connector shown in FIG. 1.

One preferred structural embodiment of the present invention will be described in detail in conjunction with a connector for vehicular AC generator shown in FIGS. 1 to 6. As shown in these figures, the connector generally comprises a connector case 1 as a resin molded article, a plurality of wiring metal pieces 2-5 fixed or embedded in the connector case 1 by inert molding or resin molding, and a leaded circuit element 6. The connector case 1 includes a body portion 12 of rectangular block-like configuration having an element-accommodating chamber of horizontally elongated U shape, and a tubular connector portion 13 projecting from the body portion 12 in an upward direction shown in FIG. 1. The leaded circuit element 6 includes an elongated element body 60 and a pair of leads 61 and 62 projecting from opposite longitudinal ends of the element body 60. The leaded element 6 in the illustrated embodiment is constituted by a passive circuit element such as a resistive element, varistors or the like.

The element-accommodating chamber 11 has an element receiving portion 11*a* extending parallel along a flat first wall 12*a* of the body portion 12, a first lead receiving portion 11*b* extending parallel along a second wall 12*b* extending from one end of the first wall 12*a* in a direction perpendicular to the first wall 12*a*, and a second lead receiving portion 11*c* extending parallel along a third wall 12*c* extending from the other end of the first wall 12*a* in a direction perpendicular to the first wall 12*a*. The element body 60 of the leaded circuit element 6 is received in the element receiving portion 11*a*, the first lead 61 of the leaded circuit element 6 is received in the first element receiving portion 11*b*, and the second lead 62 of the leaded circuit element 6 is received in the second element receiving portion 11*c*.

As shown in FIG. 1, the leads 61 and 62 are bent or curved upward at a right angle so as to form bent portions 61*a* and 62*a* having a predetermined curvature (in the illustrated embodiment, the radius of curvature of the bent portions is 2.5 mm). Stated more specifically, the lead 61 extends from one end of the element body 60 in a common longitudinal direction (leftward in FIG. 1) of the element body 60 and the element receiving portion 11*a*, then bends or curves upward at a right angle toward the connector portion 13 so as to form a bent portion 61*a*, further extends from the bent portion 61*a* in an upward direction perpendicular to the longitudinal direction of the element receiving portion 11*a*, and finally terminates in a tip end portion 61*a*. Similarly, the lead 62 extends from the other end of the element body 60 in a common longitudinal direction (rightward in FIG. 1) of the element body 60 and the element receiving portion 11*a*, then bends or curves curved upward at a right angle toward the connector portion 13 so as to form a bent portion 62*a*, further extends from the bent portion 62*a* in an upward direction perpendicular to the longitudinal direction of the element receiving portion 11*a*, and finally terminates in a tip end portion 62*b*.

The wiring metal piece 2 has two external connecting terminals 21 and 22 projecting outward from an outer surface of the body portion 12 of the connector case 1 in two mutually perpendicular directions. The wiring metal piece 3 has a connector terminal 31 projecting into the tubular connector portion 13 as an external connecting terminal, and an element connecting terminal 32 projecting into the element-accommodating chamber 11. The wiring metal piece 4 has an external connecting terminal 41 projecting outward from the outer surface of the body portion 12 of the connector case 1 in a direction parallel to the external connecting terminal 22, and a connector terminal (not shown) projecting into the tubular connector portion 13 as an external connecting terminal. The wiring metal piece 5 has an external connecting terminal 51 projecting outward from the outer surface of the body portion 12 of the connector case 1 in a direction diametrically opposite to the projecting direction of the external connecting terminal 21, and an element connecting terminal 52 projecting into the element-accommodating chamber 11. The external connecting terminals 22, 41 project from a lower side surface of the body portion 12 of the connector case 1 in a direction opposite to the projecting direction of the connector portion 13. The element connecting terminal 32 of the wiring metal piece 3 has a tip end portion (joint end portion) soldered to the tip end portion 61*b* of the lead 61. Similarly, the element connecting terminal 52 of the wiring metal piece 5 has a tip end portion point end portion) soldered to the tip end portion 62*b* of the lead 62. The element connecting terminal 32 of the wiring metal piece 3 and the element connecting terminal 52 of the wiring metal piece 5 project from the body portion 12 of the connector case 1 in a lateral leftward direction as shown in FIG. 1.

The connector case 1 has a plurality of lead support walls 14 to 17 each for supporting thereon one of the leads 61 and 62. The lead supporting wall 14 is disposed in the first lead receiving portion 11*b* of the element accommodating chamber 11 and extends in a direction transversely across the first read receiving portion 11*b* at a position located between the tip end portion 61*a* of the lead 61 and the bent portion 61*a* of the lead 61. The lead support wall 15 is disposed in the element receiving portion 11*a* of the element-accommodating chamber 11 and extends in a direction transversely across the element receiving portion 11*a* at a position between a base portion (proximal end portion not designated) of the lead 61 and the bent portion 61*a* of the lead 61. Similarly, the lead support wall 16 is disposed in the element receiving portion 11*a* of the element-accommodating chamber 11 and extends in a direction transversely across the element receiving portion 11*a* at a position between a base portion (proximal end portion not designated) of the lead 62 and the bent portion 62*a* of the lead 62. The lead supporting wall 17 is disposed in the second lead receiving portion 11*c* of the element accommodating chamber 11 and extends in a direction transversely across the second read receiving portion 11*c* at a position located between the tip end portion 62*a* of the lead 62 and the bent portion 62*a* of the lead 62.

Figure 6:
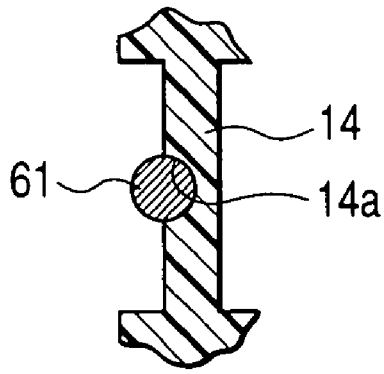
FIG. 6 is an enlarged cross-sectional view taken along line B-B of FIG. 4.

The lead support walls 14 and 15 are in contact with a back side of the lead 61 and extend perpendicularly to the lead 61. Similarly, the lead support walls 16 and 17 are in contact with a back side of the lead 62 and extend perpendicularly to the lead 62. Each of the lead support walls 14-17 has on its front surface an arcuate recess in which a portion of the lead 61, 62 is received and held therein via a frictional forced acting between the back side of the lead 61, 62 and the recessed front surface of each respective lead support wall 14-17. FIG. 6 shows one such arcuate recess 14*a* formed in the lead support wall 14. Though not shown, other lead support walls 15, 16, 17 have the same arcuate recesses.

Figure 3:
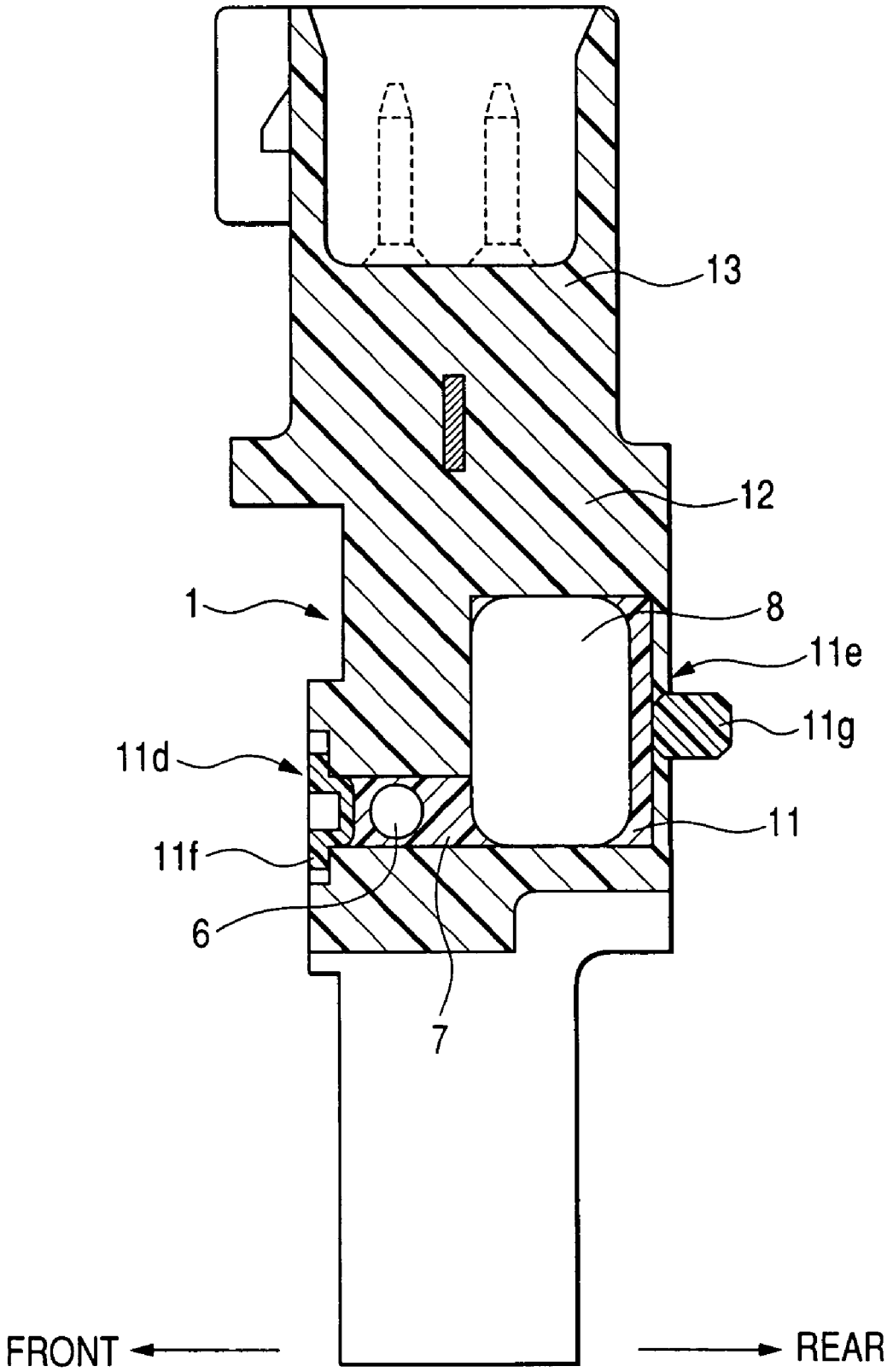
FIG. 3 is a vertical cross-sectional view of the connector shown in FIG. 1.

As shown in FIG. 3, the element-accommodating chamber 11 is filled with an elastic sealing resin 7. The element-accommodating chamber 11 has a front-side opening 11*d* and a rear-side opening 11*e*, which are sealingly closed by a front lid 11*f* and a rear lid 11*g*, respectively. The element-accommodating chamber 11 is enlarged on its rear side in an upward direction toward the connector portion 13 so as to receive therein a capacitor 8. Thus, the leaded circuit element 6 is received in a front-side portion of the element-accommodating chamber 11, and the capacitor 8 is received in an enlarged rear-side portion of the element-accommodating chamber 11. The capacitor 8 is not shown in FIG. 2 for clarity.

Figure 4:
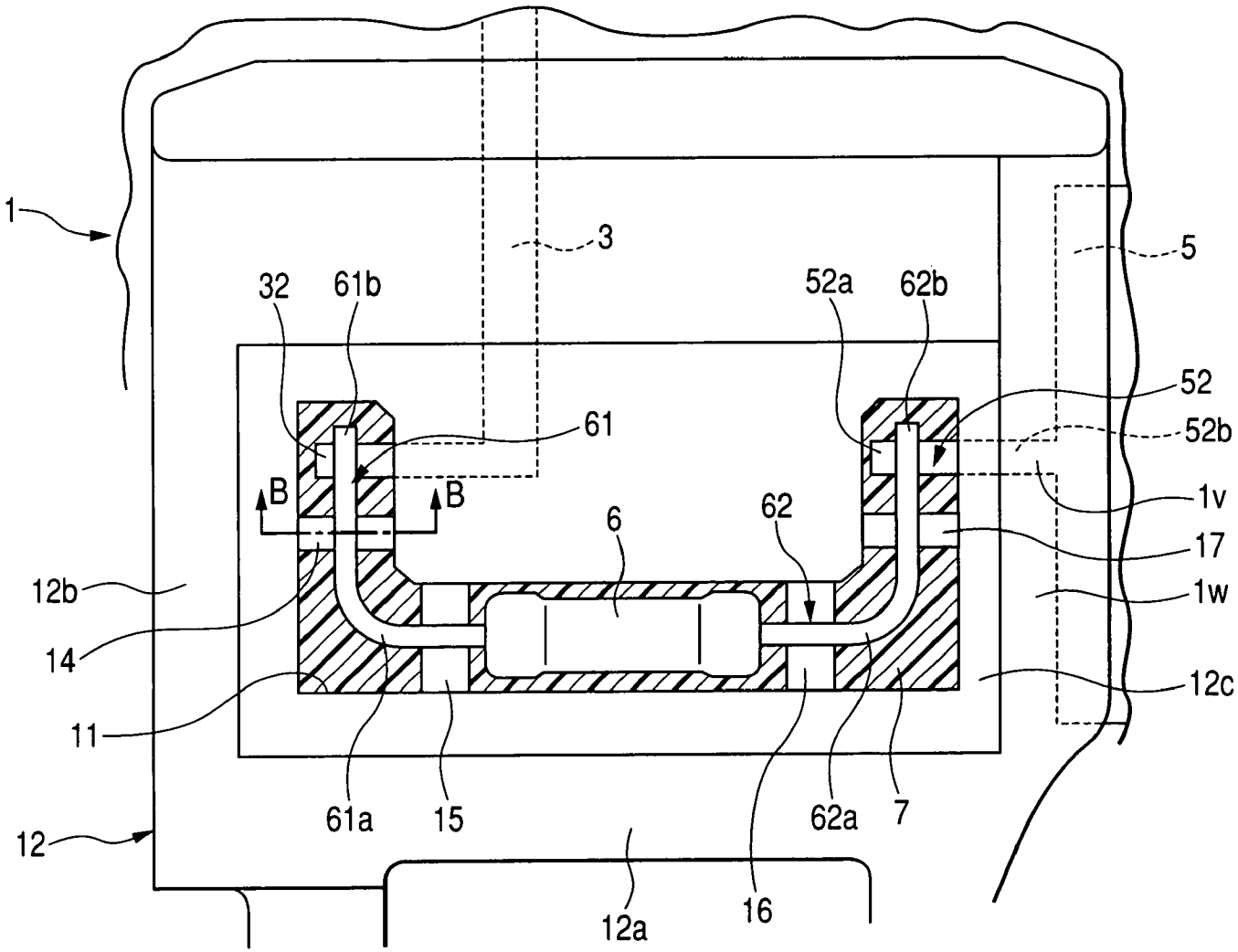
FIG. 4 is an enlarged view of a portion of FIG. 1.

As shown in FIG. 4, the element connecting terminal 52 of the wiring metal piece 5 has the joint end portion (tip end portion) 52*a* soldered to the tip end portion 62*b* of the lead 62, and a contact exposure portion 52*b* located closer to a base of the element connecting terminal 52 than the joint end portion 52*a*.

Figure 5:
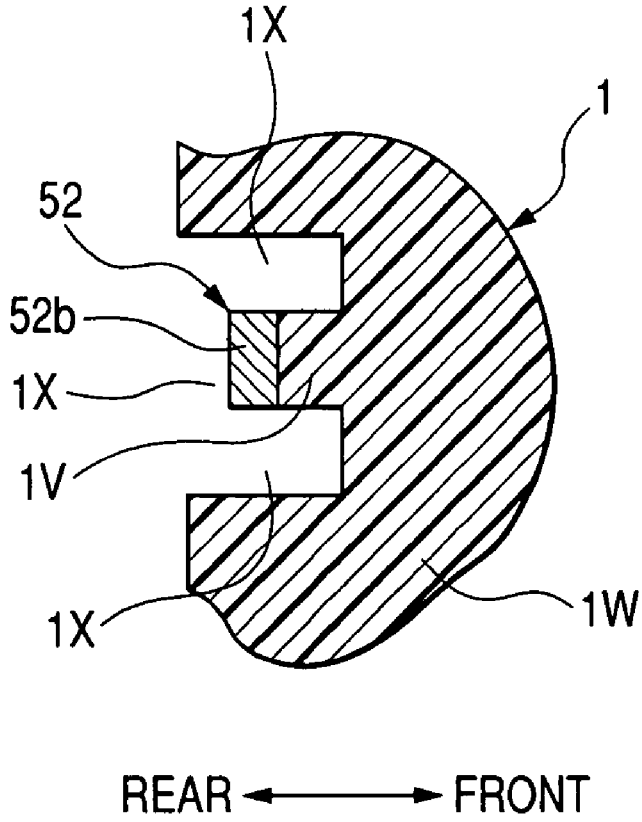
FIG. 5 is an enlarged cross-sectional taken along line A-A of FIG. 2.

The contact exposure portion 52*b* of the element connecting terminal 52 is in close contact with a wall portion 1V of the connector case 1, which is located on the front side of the element connecting terminal 52, as shown in FIG. 5. The wall portion 1V of the connector case 1 is formed as a result of formation of a cutout recess 1X of an inverted U-shape in cross-section of a wall part 1W extending along an inner surface of the connector case 1. The wall portion 1V corresponds in position to the contact exposure portion 52*b* of the element connecting terminal 52 and projects to some extent from the bottom of the inverted U-shaped cutout recess 1X toward the rear side of the connector case 1. In other words, the contact exposure portion 52*b* of the element connecting terminal 52 has a four-sided or rectangular cross-sectional shape and is in contact with the wall portion 1V of the connector case 1 only at its one flat surface facing toward the front side of the connector case 1. Remaining three flat surfaces of the contact exposure portion 52*b* are separated from the connector case 1 by virtue of the presence of the inverted U-shaped cutout recess 1X. With this arrangement, it is possible to improve the elastic deformation of the element connecting terminal 52 in other directions than the direction facing toward the wall portion 1V of the connector case 1.

Figure 7:
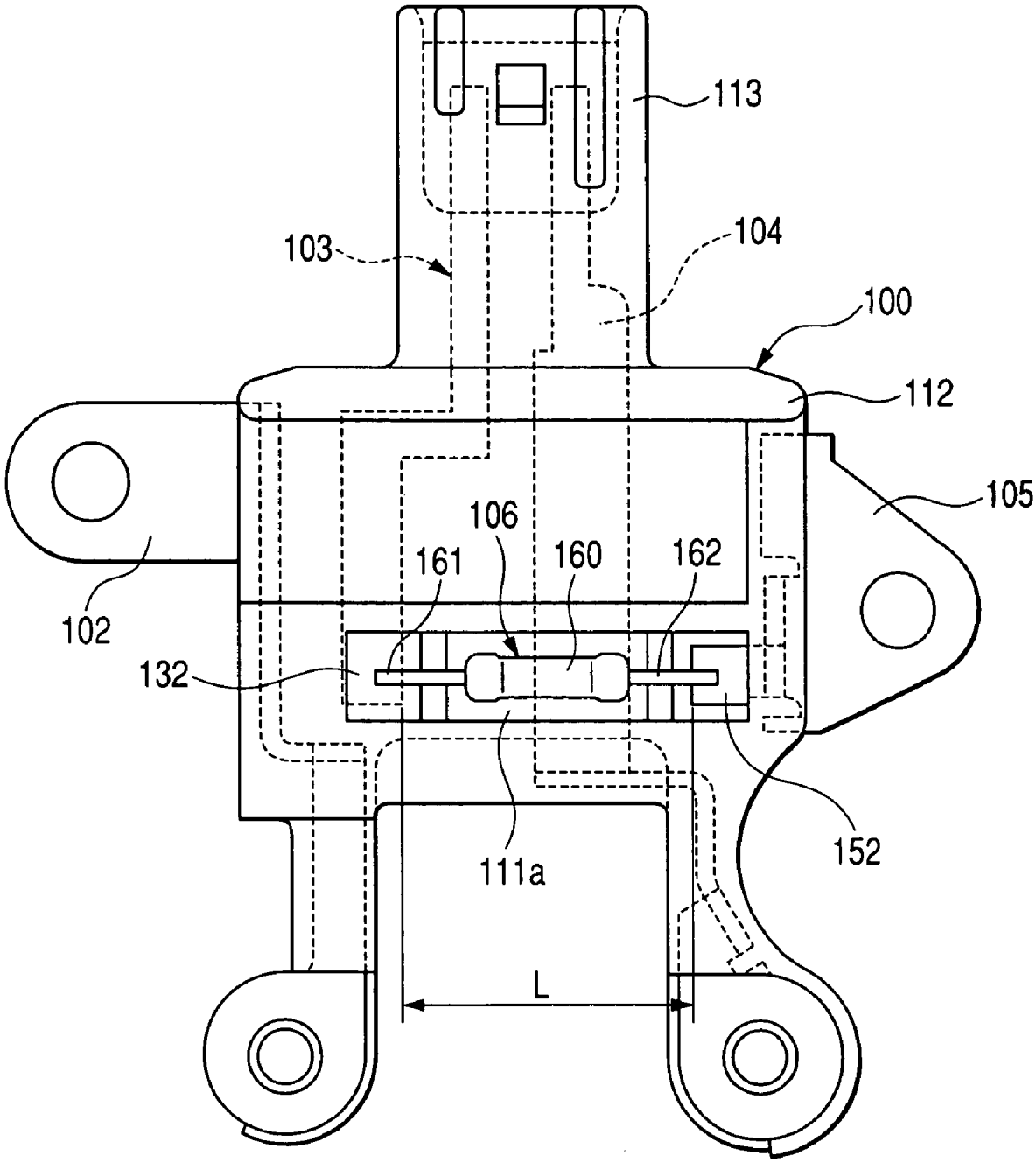
FIG. 7 (PRIOR ART)
FIG. 7 is a front elevational view of a conventional connector for vehicular AC generator.
Figure 8:
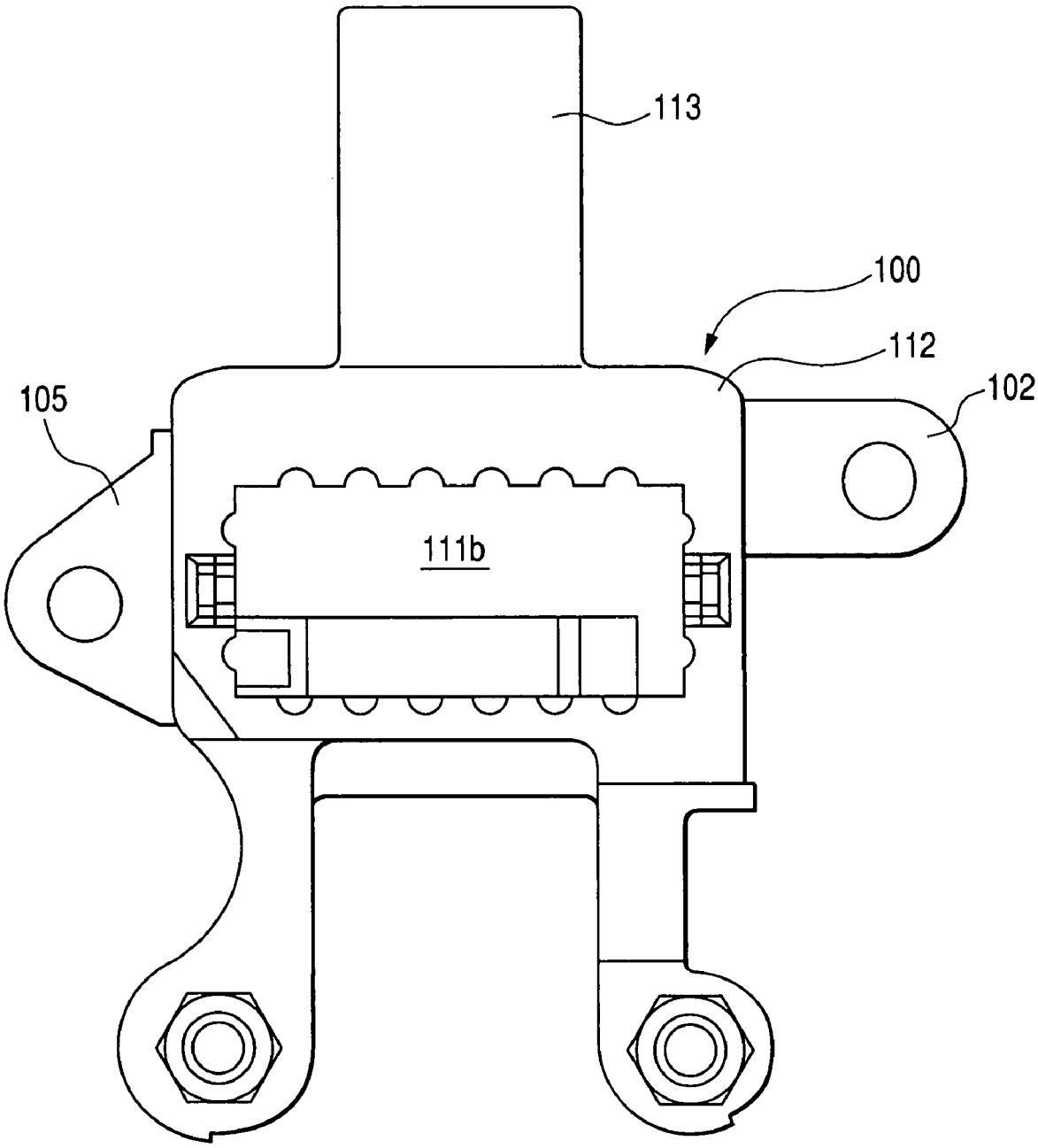
FIG. 8 (PRIOR ART)
FIG. 8 is a rear elevational view of the connector shown in FIG. 7.
Figure 9:
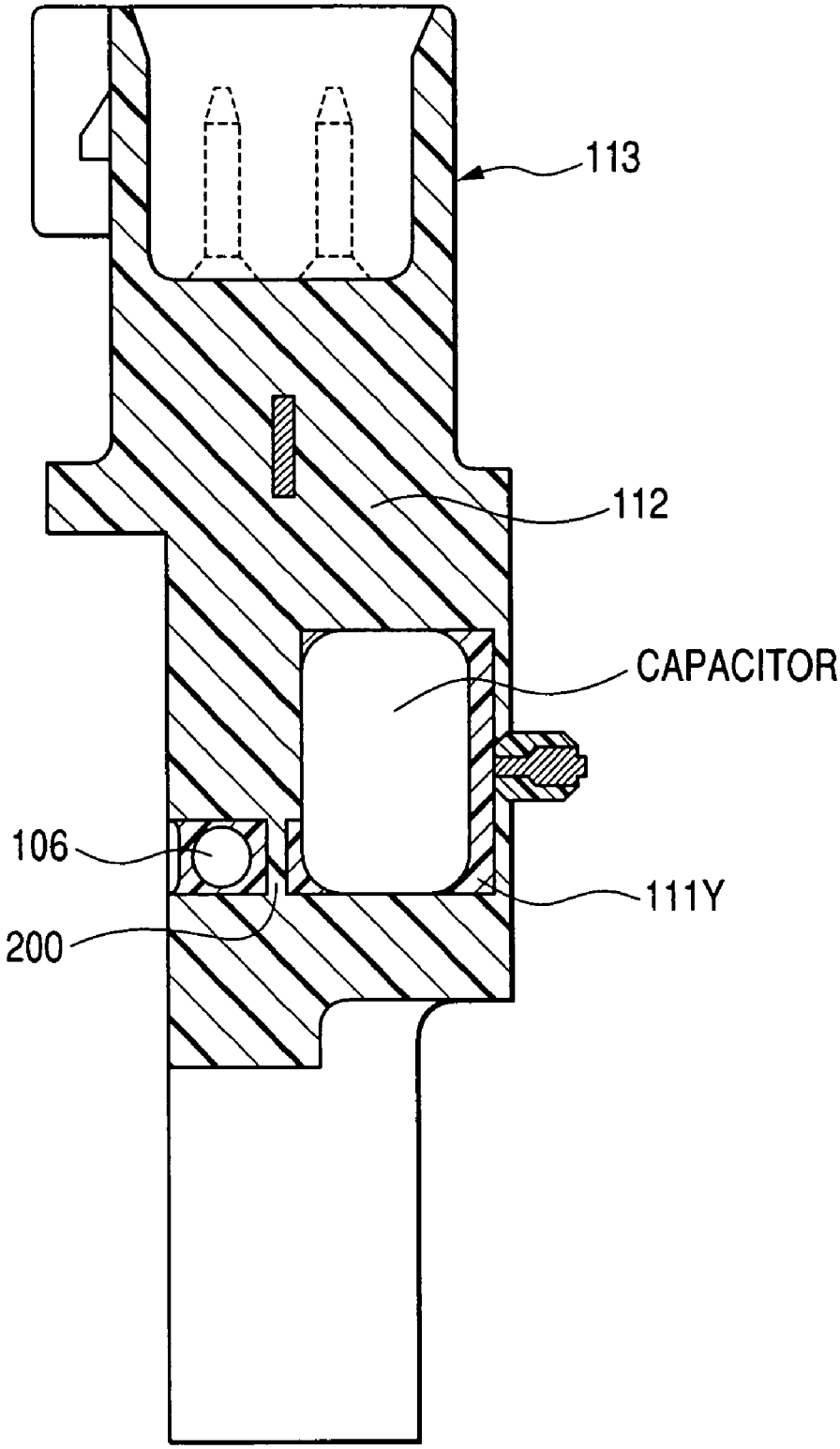
FIG. 9 (PRIOR ART)
FIG. 9 is a vertical cross-sectional view of the connector shown in FIG. 7.

Using five samples, the conventional connector with a built-in circuit element shown in FIGS. 7-9 and the inventive connector with a built-in circuit element shown in FIGS. 1-6 were subjected to a heat cycle test effected in a temperature range −30° C to 150° C. The results show that breaking of lead occurred at 500 cycles on average for the conventional connector samples and no breaking of lead was found for the inventive connector samples even after 2,000 cycles.

Obviously, various minor changes and modifications are possible in the light of the above teaching. It is to be understood that within the scope of the appended claims the present invention may be practiced otherwise than as specifically described.

What is claimed is:

1. A connector for a vehicular AC generator, comprising:

a resin connector case having a sealed element-accommodating chamber for receiving therein a circuit element;

a leaded circuit element received in the element-accommodating chamber and having a pair of leads protruding from opposite longitudinal ends thereof, each of the leads has a bent portion. which is bent at an angle of 45 degrees or greater within the element-accommodating chamber;

a plurality of wiring metal pieces embedded in the resin connector case, each of the wiring metal pieces having an external connecting terminal projecting from an outer wall of the connector case for external connection, and an element connecting terminal projecting into the element-accommodating chamber and soldered to a tip end portion of each of the leads of the leaded circuit element; and an elastic sealing resin filled in the element-accommodating chamber, wherein the connector case further has a lead support wall disposed between the tip end portion and the bent portion of each of the pair of leads and supporting thereon a portion of each respective lead, the lead support wall extending perpendicularly to each respective lead and having a recess in which the lead is received.

2. The connector according to claim 1, wherein the leads of the leaded circuit element are bent parallel to each other at right angles in the same direction.

3. The connector according to claim 1, wherein the element connecting terminal has a joint end portion completely separated from the connector case and soldered to the tip end portion of each lead, a base portion opposite to the joint end portion and fully embedded in the connector case, and a contact exposure portion disposed between the joint end portion and the base portion, the contact exposure portion being in close contact with an inner wall surface of the connector case only at a surface thereof which is hidden when viewed from an open side of the element-accommodating chamber.

4. A connector for a vehicular AC generator, comprising:

a resin connector case having a sealed element-accommodating chamber for receiving therein a circuit element;

a leaded circuit element received in the element-accommodating chamber and having a pair of leads protruding from opposite longitudinal ends thereof, each of the leads has a bent portion. which is bent at an angle of 45 degrees or greater within the element- accommodating chamber;

a plurality of wiring metal pieces embedded in the resin connector case, each of the wiring metal pieces having an external connecting terminal projecting from an outer wall of the connector case for external connection, and an element connecting terminal projecting into the element-accommodating chamber and soldered to a tip end portion of each of the leads of the leaded circuit element; and an elastic sealing resin filled in the element-accommodating chamber, wherein the connector case has a rectangular block-like configuration having a flat first wall, a flat second wall extending perpendicularly from one end of the first wall, and a flat third wall extending perpendicularly from the other end of the first wall and parallel to the second wall, and wherein the element-accommodating chamber includes an element receiving portion extending substantially parallel to and along the first wall of the connector case and receiving therein a body portion of the leaded circuit element in substantially parallel spaced relation to the first wall, a first lead receiving portion extending substantially parallel to and along the second wall of the connector case and receiving therein one of the pair of the leads in substantially parallel spaced relation to the second wall, and a second lead receiving portion extending substantially parallel to and along the third wall of the connector case and receiving therein the other lead in substantially parallel spaced relation to the third wall.

5. The connector according to claim 4, wherein the connector case further has a pair of lead support walls extending perpendicularly to each other and supporting each of the leads at portions located on opposite sides of the bent portion of each respective lead.

* * * * *